US011225884B2

(12) United States Patent
Haxhiu et al.

(10) Patent No.: US 11,225,884 B2
(45) Date of Patent: Jan. 18, 2022

(54) ROCKER ARM FOR A VALVE TRAIN OF AN INTERNAL COMBUSTION ENGINE, AND METHOD FOR THE NON-CUTTING PRODUCTION OF AN ARM FROM STEEL SHEET

(71) Applicant: Schaeffler Technologies AG & Co. KG, Herzogenaurach (DE)

(72) Inventors: Arben Haxhiu, Herzogenaurach (DE); Martin Lambert, Homburg (DE); Michael Schewe, Herzogenaurach (DE); Bernhard Kühnel, Höchstadt (DE); Matthias Thoelking, Bexbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/767,609

(22) PCT Filed: Sep. 21, 2018

(86) PCT No.: PCT/DE2018/100801
§ 371 (c)(1),
(2) Date: May 28, 2020

(87) PCT Pub. No.: WO2019/110031
PCT Pub. Date: Jun. 13, 2019

(65) Prior Publication Data

US 2020/0370447 A1 Nov. 26, 2020

(30) Foreign Application Priority Data

Dec. 4, 2017 (DE) ..... 10 2017 128 683.7
Dec. 6, 2017 (DE) ..... 10 2017 128 931.3

(51) Int. Cl.
*F01L 1/18* (2006.01)
*B21D 53/84* (2006.01)
*F01L 1/46* (2006.01)

(52) U.S. Cl.
CPC ..... *F01L 1/185* (2013.01); *B21D 53/84* (2013.01); *F01L 1/46* (2013.01); *F01L 2303/00* (2020.05);
(Continued)

(58) Field of Classification Search
CPC ..... F01L 1/185; F01L 1/46; F01L 2303/00; F01L 2305/00; F01L 2305/02; F01L 2810/02; B21D 53/84
See application file for complete search history.

(56) References Cited

U.S. PATENT DOCUMENTS 4,829,647 A 5/1989 Anderson et al.
6,227,156 B1 * 5/2001 Autrey ..... F01L 1/18 123/90.41
2013/0263695 A1 10/2013 Witter et al.

FOREIGN PATENT DOCUMENTS

CN 101100952 A 1/2008
CN 101100952 B 8/2012
(Continued)

*Primary Examiner* — Zelalem Eshete
(74) *Attorney, Agent, or Firm* — Matthew Evans

(57) ABSTRACT

A rocker arm has two side walls and two webs which run transversely with respect to the side wall. The webs connect the side walls to one another on end-side sections, wherein a valve stem support is configured on one of the webs, and a spherical cap is configured on the other web. A cam roller is arranged in a roller pocket which is delimited by the webs and the side walls. The cam roller is mounted rotatably on a roller axle which is fixed in the side walls. Projections are arranged within the roller pocket such that they are spaced apart from the respective web to guide the cam roller. The projections extend from the side walls in the direction of the
(Continued)

cam roller to form guide surfaces which interact with end surfaces of the cam roller.

15 Claims, 4 Drawing Sheets

(52) U.S. Cl.
CPC ..... *F01L 2305/00* (2020.05); *F01L 2810/02* (2013.01)

(56) References Cited

FOREIGN PATENT DOCUMENTS

| | | | |
|---|---|---|---|
| CN | 103362581 | A | 10/2013 |
| DE | 9400898 | U1 | 2/1997 |
| DE | 10218026 | A1 | 11/2003 |
| DE | 102006048342 | A1 | 4/2008 |
| DE | 102008034648 | A1 | 1/2010 |
| DE | 102010005606 | A1 | 7/2011 |
| DE | 102011077024 | A1 | 12/2012 |
| DE | 102011089396 | A1 | 6/2013 |
| DE | 102013200167 | A1 | 7/2014 |
| DE | 102013210390 | A1 | 12/2014 |
| DE | 102017128931 | B3 | 5/2019 |
| JP | H06-79383 | A | 3/1994 |

* cited by examiner

ROCKER ARM FOR A VALVE TRAIN OF AN INTERNAL COMBUSTION ENGINE, AND METHOD FOR THE NON-CUTTING PRODUCTION OF AN ARM FROM STEEL SHEET

CROSS-REFERENCE TO RELATED APPLICATIONS

This application is the U.S. National Phase of PCT Application No. PCT/DE2018/100801 filed on Sep. 21, 2018, which claims priority to DE 10 2017 128 683.7 filed on Dec. 4, 2017 and DE 10 2017 128 931.3 filed on Dec. 6, 2017, the entire disclosures of which are incorporated by reference herein.

TECHNICAL FIELD

This disclosure concerns a rocker arm for a valve train of an internal combustion engine with an arm body produced without cutting from steel sheet and having a U-shaped cross-section open at the bottom, such that an opening of the U-shape is facing downward toward a valve stem.

BACKGROUND

A rocker arm is known from U.S. Pat. No. 4,829,647 A. According to this, firstly a plate is punched out of a steel sheet provided as strip material, which plate already has a convex shape on its long sides in order to form convex edges at the lower edges of side walls of the finished arm. In the next method step, a bone-shaped opening is made in the plate by a punching process. In its middle region on its two longitudinal extents, this opening has a concave course so as to give in general the bone-shaped outer contour of the opening. This ensures a greater stiffness of the arm in its middle region in which a cam roller is arranged in the finished rocker arm. Also, orifices are made in the plate for later receiving a roller axle and as a splash bore of a spherical cap. The spherical cap, the longitudinal grooves and annular shoulders surrounding the orifices are formed in the plate by a non-cutting forming process. Then the parts of the plate which form the side walls of the arm are bent along the grooves against webs, so as to give the U shape of the arm.

DE 10 2011 077 024 A1 discloses a rocker arm produced without cutting, in which the arm part is also produced in the method described above. A needle cage, which mounts a cam roller on a roller axle fixed in the side walls, protrudes axially over the cam roller. Thus a space is created in the side walls for the axially protruding needle cage, for which the respective side wall is formed bulging and bears on and hence guides the corresponding end of the cam roller outside the radial extent of the needle cage.

A similar design of an axial stop for a cam roller is disclosed in DE 10 2010 005 606 A1. The arm used for the rocker arm has a U-shaped cross-section open at the top. A web connecting the side walls has folded tabs which guide a valve stem end of a gas exchange valve. Narrow portions of the two webs connecting the side walls extend on both sides of the cam roller in a part region at the ends of a roller pocket, and in this part region form an axial stop for the end faces of the cam roller.

Publication DE 10 2008 034 648 A1 describes a rocker arm, the arm of which has a U-shaped cross-section at the top, wherein local elevations are provided in the side walls. These stop faces for an end of a cam roller are produced by embossing the side walls. Because of the U-shape of the arm, open at the top, the valve stem must be guided by folded tabs on the web provided for valve stem support.

SUMMARY

It is an object of the present disclosure to establish on the arm an advantageous guidance of a cam roller arranged inside the roller pocket of the arm, which can be produced by simple means. It is also an object of the disclosure to reduce the structural length of the arm.

This object is achieved by the features of the embodiments described herein.

According to the disclosure, protrusions extend from within the roller pocket, spaced from the webs, and run towards the cam roller from the side walls on both sides of the cam roller. Each of the protrusions form a guide face which cooperates with a respective end face of the cam roller, wherein the two protrusions are formed as angled sheet metal portions pointing towards each other and extending from an upper edge of the side walls in the region of the roller pocket.

In a top view onto the arm, the roller pocket has a substantially rectangular outer contour, the longest extent of which is limited by the side walls. At each end, the roller pocket is limited by one of the webs. The protrusions are provided opposite each other on the side walls and are arranged spaced from the web or webs. The end faces of the cam roller adjacent to the guide faces run on the guide faces provided at the respective ends of the protrusions. The protrusions are angled from the side walls at their upper edge delimiting the roller pocket. Together with the side walls, firstly a sheet strip is formed, preferably a connecting web, which is detached so as to form the protrusion angled from an upper edge of the respective side wall.

In a further embodiment of the disclosure, the roller pocket extends up to the web in which a spherical cap is formed. It is furthermore provided that the web, which is offset downward relative to the upper edge of the side walls, runs on a lower edge of the spherical cap and is connected to the respective side wall via a doubling or folding of the side walls. There is therefore no web at the end of the roller pocket facing the spherical cap and running level with the edges of the side walls. The roller pocket directly adjoins the spherical cap, wherein the web receiving the spherical cap—which is offset downward relative to the edges—extends from the doubling of the side walls. In this way, the length of the rocker arm can be reduced. According to the disclosure, the cam roller guidance can be spaced from the corresponding end of the roller pocket by means of the protrusions.

Furthermore it is provided according to the disclosure that in the second method step, at least two openings are produced with at least one connecting web separating these from each other and running in the direction of their transverse extent, and that after the third method step, in a fourth method step the connecting web is detached with a spacing from an edge of the roller pocket.

Thus, the connecting web is provided inside the opening of the plate formed with a bone-shaped outer contour, and divides this into two openings. If now the plate is formed into a U-shaped arm blank, the connecting web runs transversely to the roller pocket. This is detached on both sides with a spacing from the lateral limit of the roller pocket, so as to form protrusions forming the guide faces.

Then as proposed, the connecting web can be detached by a punching process. Alternatively, to detach the connecting web, a cutting or milling process may be provided. At one end of the arm, a spherical cap is produced in one of the webs by means of a non-cutting forming process, wherein this web directly adjoins the roller pocket. The portions of the side walls running in this region have a doubling, i.e. these wall portions are formed in opposite directions, so that at this end the arm has a U-shape open at the top. The dimensions of the resulting web substantially restrict it to receiving the spherical cap and connecting the doubled wall portions.

BRIEF DESCRIPTION OF THE DRAWINGS

For further explanation of the disclosure, reference is made to the drawings which show an exemplary embodiment in simplified form. In the drawings.

DETAILED DESCRIPTION

Figure 1:
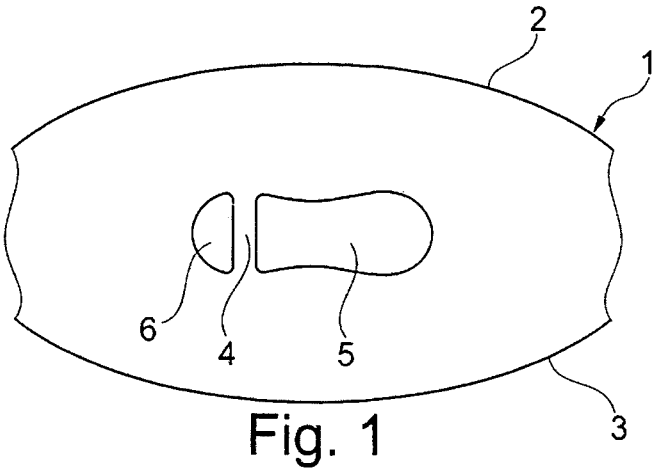
FIG. 1 shows a top view of a plate punched out of a steel sheet, which in a further punching process is provided with an opening having a connecting web.

In FIG. 1, a plate punched out of a sheet strip and having convexly curved outer edges 2 and 3 on its long sides is designated "1". This plate 1 is produced by a punching process in a first method step. In a second method step, in a further punching process, the plate 1 is provided with two openings 5 and 6 separated from each other by a connecting web 4. Without the connecting web 4 separating the openings 5 and 6, there would be as a whole one orifice of bone-shaped outer contour. During a further forming process, a U-shaped blank is produced from the plate 1.

Figure 2:
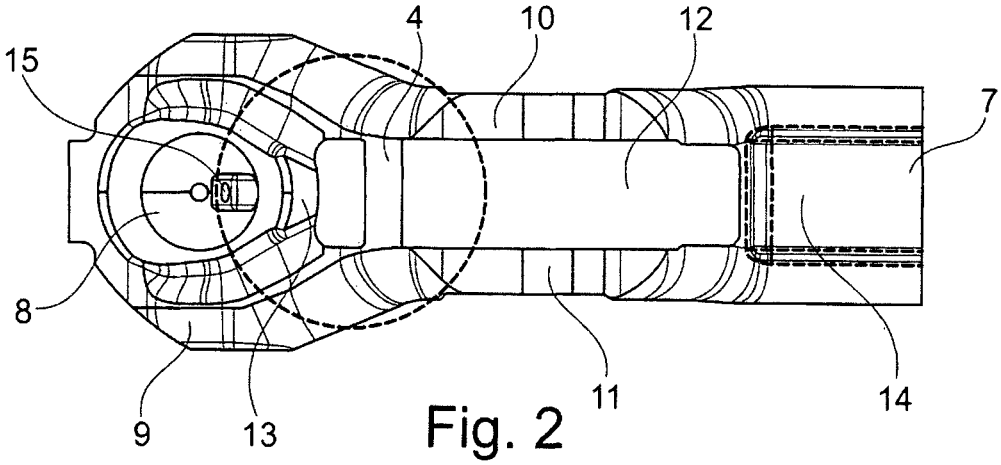
FIG. 2 shows a top view of a U-shaped arm body which is produced from the plate in a non-cutting forming process, wherein the connecting web runs inside a roller pocket formed by the opening.
Figure 3:
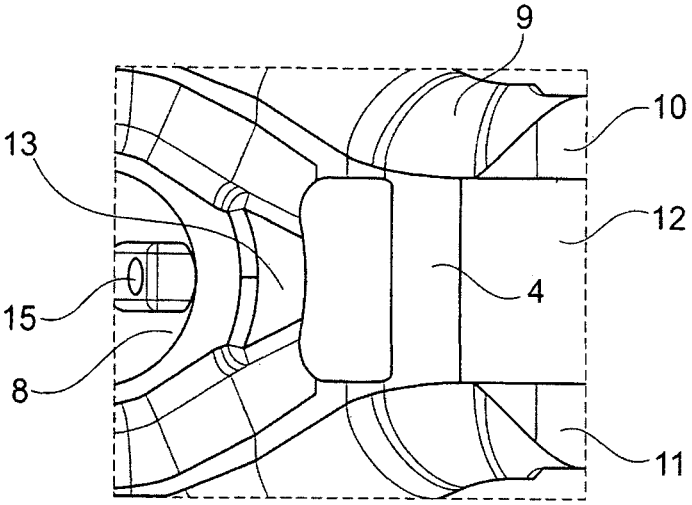
FIG. 3 shows an enlarged partial view of the arm body in the region of the connecting web.
Figure 4:
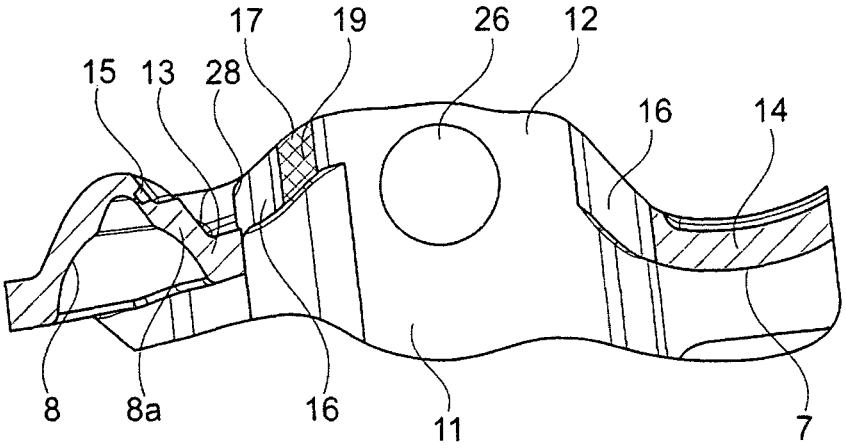
FIG. 4 shows a side view of the arm body, wherein a substantial part of the connecting web has been removed and only parts thereof protrude as protrusions into the roller pocket.
Figure 5:
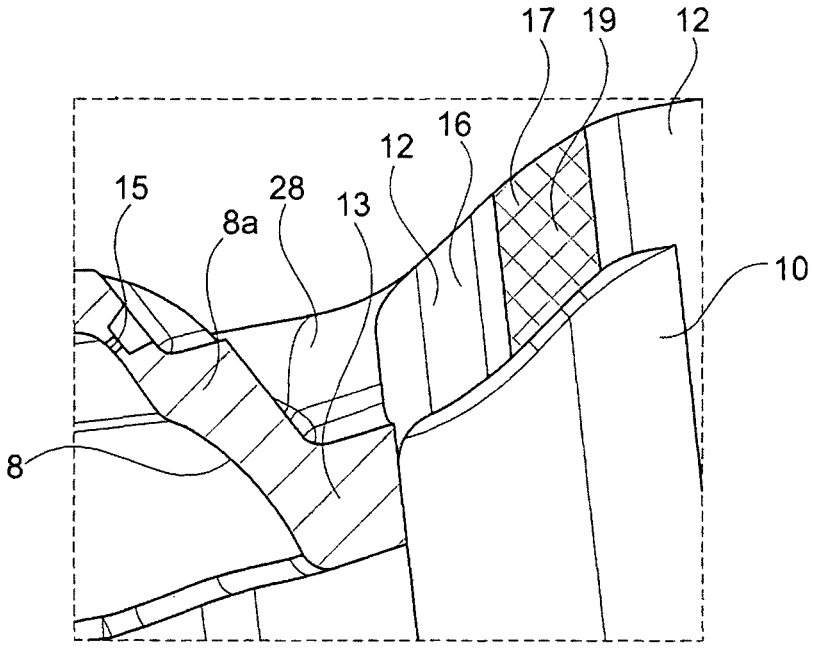
FIG. 5 shows an enlarged partial view of the side view of the arm body shown in FIG. 4, showing the position and form of one of the protrusions.
Figure 6:
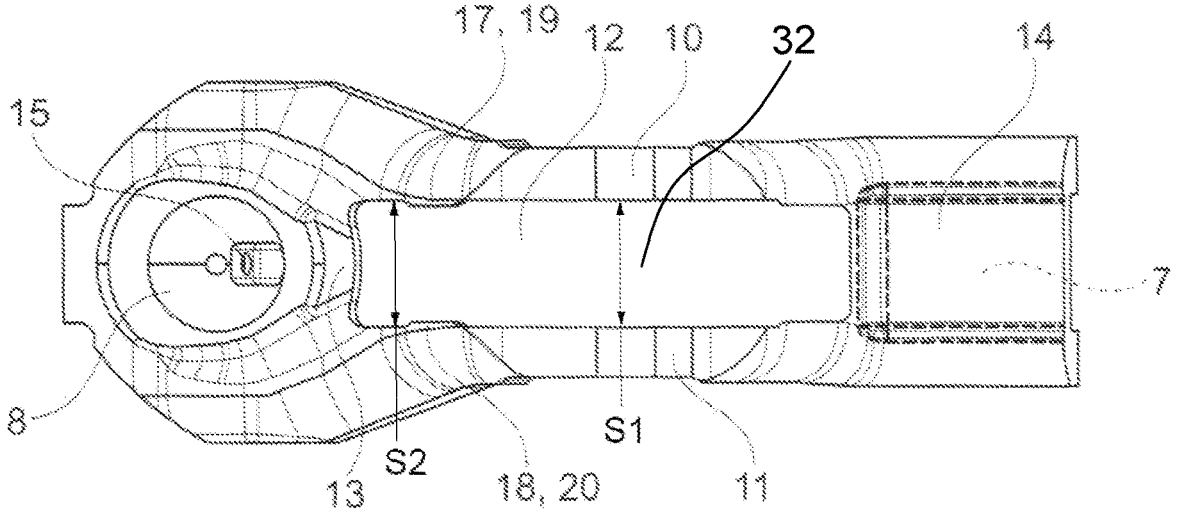
FIG. 6 shows a top view of the arm body from FIG. 4.
Figure 7:
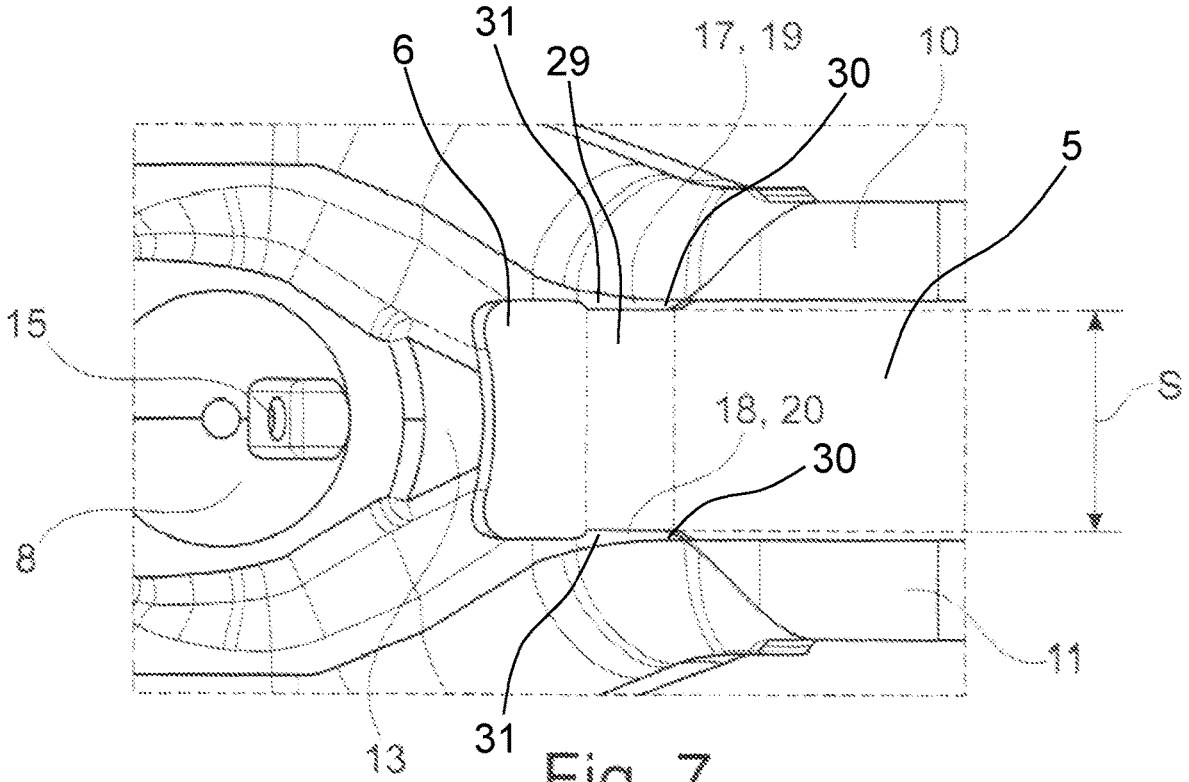
FIG. 7 shows an enlarged partial view of the top view of the arm body shown in FIG. 6.
Figure 8:
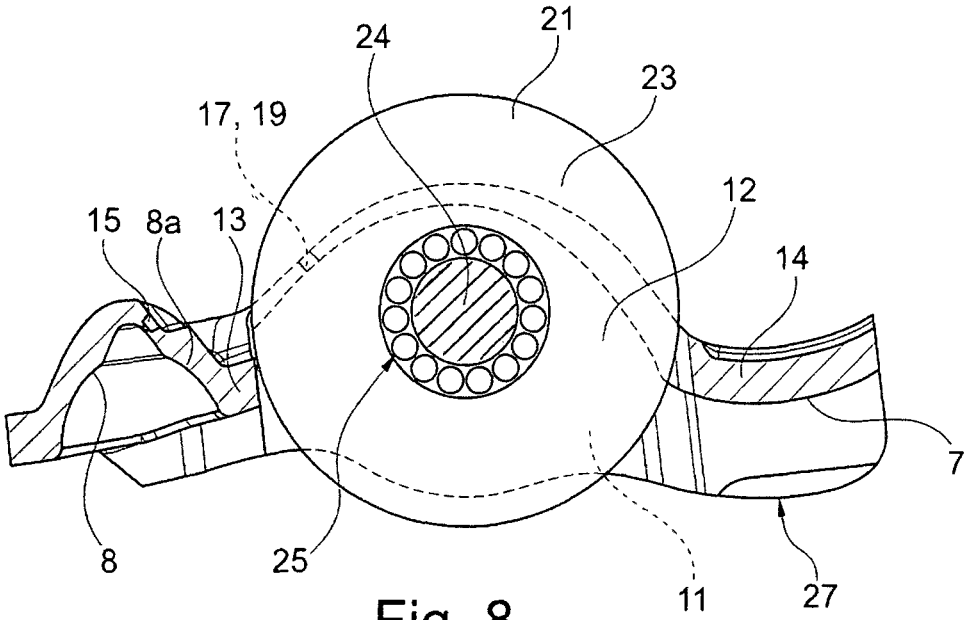
FIG. 8 shows a side view of a rocker arm made using the arm body of FIGS. 4 to 7 and having a cam roller.

Then by further forming processes, which may be embossing processes, a valve stem support 7 (shown in FIGS. 2, 4, 6, 8 and 9) and a spherical cap 8 (shown in FIGS. 2 to 8) are produced from this blank, giving the arm 9 shown amongst others in FIGS. 2 and 3. This arm body 9 has side walls 10 and 11 which at their upper end delimit a roller pocket 12. Outside this roller pocket 12 provided in the middle region 32 of the arm body 9, i.e. in the region of the two ends of the arm body 9, the side walls 10 and 11 are connected together via webs 13 and 14. Here the spherical cap 8 is formed in the web 13, and as shown in FIGS. 4, 5 and 8 has a cap wall 8*a* and a splash bore 15. In the region of the web 14, the side walls 10 and 11 laterally delimit the valve stem support 7 formed on the underside of the web 14.

The roller pocket 12 is the substantially rectangular space delimited by the side walls 10 and 11 and the two webs 13 and 14. As shown in FIGS. 2 and 3, the connecting web 4 (still present) runs inside this roller pocket 12 between the two upper edges of the side walls 10 and 11, as provided previously in the plate 1 according to FIG. 1. If a collar 16, protruding into the roller pocket 12, is provided at least in part regions of each upper edge of the side walls 10 and 11, as shown for example in FIGS. 4, 5 and 8, the connecting web 4 shown in FIGS. 2 and 3 extends from this collar 16.

Figure 9:
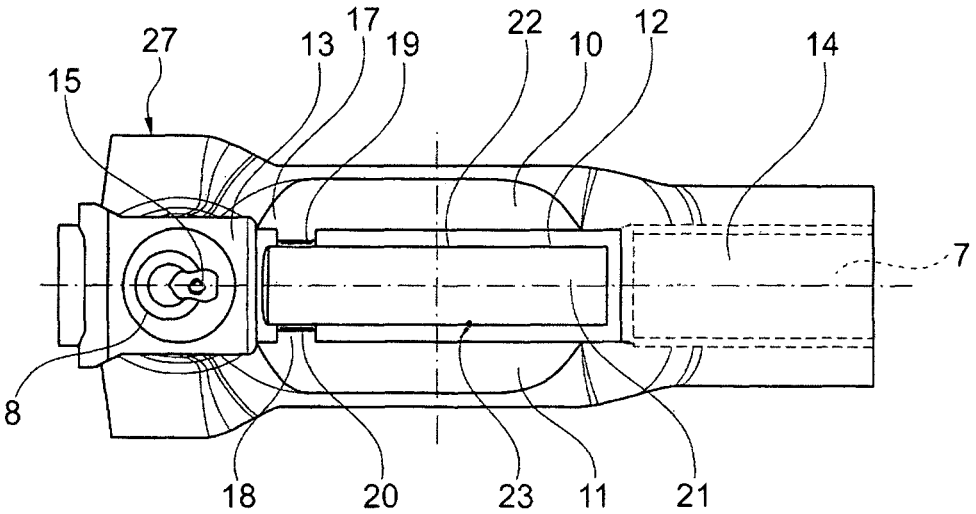
FIG. 9 shows a top view of the rocker arm.

In a further method step, the connecting web 4 is removed so as to leave only the protrusions 17 and 18, shown in FIGS. 4 to 9, extending from the side walls 10 and 11 or the respective collar 16 and protruding into the roller pocket 12 to form an opening 29 that is adjoined to openings 5, 6. These protrusions 17, 18 have guide faces 19 and 20 which run towards each other spaced by a transverse distance S (see FIG. 7), which is dimensioned such that a cam roller 21 later inserted in the roller pocket 12 (as shown in FIGS. 8 and 9) is guided via these guide faces 19 and 20 by running thereon with its end faces 22 and 23. The protrusions 17, 18 separate the two openings 5, 6, such that a first end 30 of each of the protrusions is adjoined to the openings 5, and a second end 31 of each of the protrusions is adjoined to the opening 6 (see FIG. 7). The transverse distance S between the guide faces 19, 20 is lens than, i) a transverse distance S1 of the opening S that is adjoined to the protrusions 17, 18, and ii) a transverse distance S2 of the opening 6 that is adjoined to the protrusions 17, 18. The splash bore 15 of the ball cap 8 described above is oriented so that lubricant is splashed through this onto the periphery of the cam roller 21.

For rotatable mounting of the cam roller 21 on a roller axle 24, a needle roller bearing 25 is provided which can be a full-complement needle roller bearing. As FIG. 4 in particular shows, bores 26 in which the roller axle 24 can be fixed are provided in the side walls 10 and 11. The corresponding arrangement of the cam roller 21 in the arm body 9 creates a rocker arm 27 (shown in FIGS. 7 and 8) for use in a valve train of a reciprocating piston internal combustion engine.

As furthermore shown in particular by FIG. 5, the spherical cap 8 extends from a lower end out of the web 13 and hence delimits the roller pocket 12 at this point. Thus, in this region there is no need for a wider web which would normally connect together the side walls 10 and 11 at their upper edges. Starting from the edges, the side wall 10 rather has a doubling 28 which extends downward and transforms into the web 13 so as to receive the spherical cap 8. In this way, the arm body 9 as a whole can be shortened, so that the rocker arm 27 can be designed shorter and consequently a very compact arrangement of the valve train is possible.

LIST OF REFERENCE CHARACTERS

1 Plate
2 Outer edge of 1
3 Outer edge of 1
4 Connecting web
5 Opening
6 Opening
7 Valve stem support
8 Spherical cap, pivot point
8*a* Cap wall
9 Arm body
10 Side wall
11 Side wall
12 Roller pocket
13 Web
14 Web

15 Splash bore
16 Collar
17 Protrusion
18 Protrusion
19 Guide face
20 Guide face
21 Cam roller
22 End face of 21
23 End face of 21
24 Roller axle
25 Needle roller bearing
26 Bore
27 Rocker arm
28 Doubling
29 Opening
30 First end of 17 and 18
31 Second end of 17 and 18
32 Middle region
S Transverse distance between 19 and 20
S1 Transverse distance of 5
S2 Transverse distance of 6

The invention claimed is:

1. A rocker arm for a valve train of an internal combustion engine, the rocker arm comprising:

an arm body produced by forming a steel sheet, the arm body having a U-shaped cross-section configured to open toward an engine valve stem, the arm body having:

two side walls connected together at end portions via webs extending transversely to the two side walls, a valve stem support formed on one of the webs, a pivot formed on another of the webs, and a roller pocket delimited by the webs and the two side walls, the roller pocket configured to receive a cam roller rotatably mounted on a roller axle fixed to the two side walls, the roller pocket having:

a first opening, a second opening, a first protrusion extending transversely within the roller pocket from one of the two side walls, and a second protrusion extending transversely within the roller pocket from a remaining one of the two side walls, and the first and second protrusions separating the first and second openings such that a first end of each of the first and second protrusions is adjoined to the first opening and a second end of each of the first and second protrusions is adjoined to the second opening, the first and second protrusions forming a third opening defined by a first transverse distance, the first transverse distance less than: i) a second transverse distance of the first opening, and ii) a third transverse distance of the second opening, and each of the first and second protrusions having a guide face configured to limit axial movement of the cam roller within the roller pocket.

2. The rocker arm of claim 1, wherein the roller pocket is formed within a middle region of the arm body.

3. The rocker arm of claim 1, wherein the third opening is adjoined to the first and second openings.

4. The rocker arm of claim 1, wherein the third opening is arranged between the first opening and the second opening relative to a longitudinal direction of the roller pocket.

5. A method for forming a rocker arm body from steel sheet for a valve train of a reciprocating piston internal combustion engine, the method comprising:

punching a plate from a steel sheet, punching at least two openings from the plate, the at least two openings: i) defining a bone-shaped outer contour with a longitudinal extent and a transverse extent, ii) forming a roller pocket configured to receive a cam roller, and iii) defining at least one connecting web configured to separate the at least two openings, the at least one connecting web extending in the transverse extent of the bone-shaped outer contour, forming the plate to a U-shape, the U-shape defining:

a middle region having the roller pocket, two side walls, and two webs, the two webs and the two side walls delimiting the roller pocket, and detaching the at least one connecting web to form at least one protrusion, the at least one protrusion extending transversely relative to the roller pocket and configured to engage an end face of the cam roller.

6. The method of claim 5, wherein the at least one connecting web is detached in a punching process.

7. The method of claim 5, wherein a spherical cap is produced via a forming process, the spherical cap configured as a pivot point in one of the two webs, and the one of the two webs directly adjoins the roller pocket.

8. The method of claim 5, wherein the at least one protrusion includes two protrusions configured to extend towards each other.

9. The method of claim 5, wherein the at least one protrusion extends from an upper edge of at least one of the two side walls.

10. The method of claim 5, wherein each of the two side walls includes a bore, each bore configured to receive a roller axle configured for mounting the cam roller.

11. The method of claim 5, wherein the two side walls are connected to each other via the at least one connecting web.

12. A rocker arm for a valve train of an internal combustion engine, the rocker arm comprising:

an arm body produced by forming a steel sheet and having a U-shaped cross-section configured to open toward a valve stem, the arm body having:

two side walls connected together at end portions of the arm body via webs running transversely to the side walls, a valve stem support formed on one of the webs, a pivot formed on another of the webs, and a roller pocket delimited by the webs and the two side walls, the roller pocket configured to receive a cam roller rotatably mounted on a roller axle fixed on the two side walls, the roller pocket having:

a first opening, a second opening, and two transversely extending protrusions forming a third opening, the two transversely extending protrusions separating the first opening from the second opening, each of the two transversely extending protrusions having a first end adjoined to the first opening, and a second end adjoined to the second opening, and each of the two transversely extending protrusions forming a guide face configured to engage a respective end face of the cam roller, and the two transversely extending protrusions are spaced apart a first transverse distance within the roller pocket, and the first transverse distance is less than: i) a second transverse distance of the first opening, and ii) a third transverse distance of the second opening.

13. The rocker arm of claim 12, wherein the roller pocket is formed within a middle region of the arm body.

14. The rocker arm of claim 12, wherein the pivot is configured with a splash bore to provide lubricant to the cam roller.

15. The rocker arm of claim 12, wherein the third opening is arranged between the first opening and the second opening relative to a longitudinal direction of the roller pocket.

* * * * *